United States Patent [19]

Dale et al.

[11] Patent Number: 4,997,388

[45] Date of Patent: Mar. 5, 1991

[54] ELECTRICAL TAP CONNECTOR

[75] Inventors: James L. Dale; Vernon R. Miller, both of Atlanta; Lincoln E. Roberts, Decatur, all of Ga.

[73] Assignee: AMP Incorporated, Harrisburg, Pa.

[21] Appl. No.: 400,315

[22] Filed: Aug. 28, 1989

[51] Int. Cl.[5] ..... H01R 4/24

[52] U.S. Cl. ..... 439/404; 439/499; 439/752; 439/110

[58] Field of Search ..... 439/492–499, 439/638, 639, 640, 650, 651, 655, 110, 111, 114, 119, 211, 212, 213, 404, 405, 731, 752

[56] References Cited

U.S. PATENT DOCUMENTS

| | | | |
|---|---|---|---|
| 3,444,506 | 5/1969 | Wedekind . | |
| 4,023,883 | 5/1977 | Raposa et al. | 339/98 |
| 4,068,912 | 1/1978 | Hudson et al. | 339/99 |
| 4,209,219 | 6/1980 | Proietto | 339/99 R |
| 4,386,820 | 6/1983 | Dola et al. | 439/651 |
| 4,387,949 | 6/1983 | Haitmanek | 339/125 R |
| 4,462,656 | 7/1984 | Beyer | 439/655 |
| 4,463,998 | 8/1984 | Reavis et al. | 339/40 |
| 4,479,692 | 10/1984 | Greenwood et al. | 339/99 R |
| 4,480,889 | 11/1984 | Greenwood | 339/99 R |
| 4,533,201 | 8/1985 | Wasseklein, Jr. | 339/99 R |
| 4,589,715 | 5/1986 | Weisenburger | 339/17 F |
| 4,607,906 | 8/1986 | Munroe | 439/650 |
| 4,668,039 | 5/1987 | Marzili | 339/99 R |
| 4,740,167 | 4/1988 | Millhimes et al. | 439/92 |
| 4,830,626 | 5/1989 | Liu | 439/650 |

*Primary Examiner*—David L. Pirlot
*Attorney, Agent, or Firm*—Robert W. Pitts

[57] ABSTRACT

Cable tap assembly for selectively connecting tap conductors to cable wire conductors comprises a housing having a cable wire locator for locating the cable wires in predetermined coplanar positions. A plurality of bus conductors are provided in the housing and extend parallel to the cable wires with each bus conductor being dedicated to, and associated with, a single cable wire. The bus conductors have receptacle sites which are accessible from the exterior of the housing so that terminals can be mated with the bus conductors. Connecting devices extend from the bus conductors to the cable wires. The assembly has a major surface having defined zones, each of which receives an electrical connector that has male terminals which are mated with specific cable wires when the connector is coupled to the major surface.

25 Claims, 14 Drawing Sheets

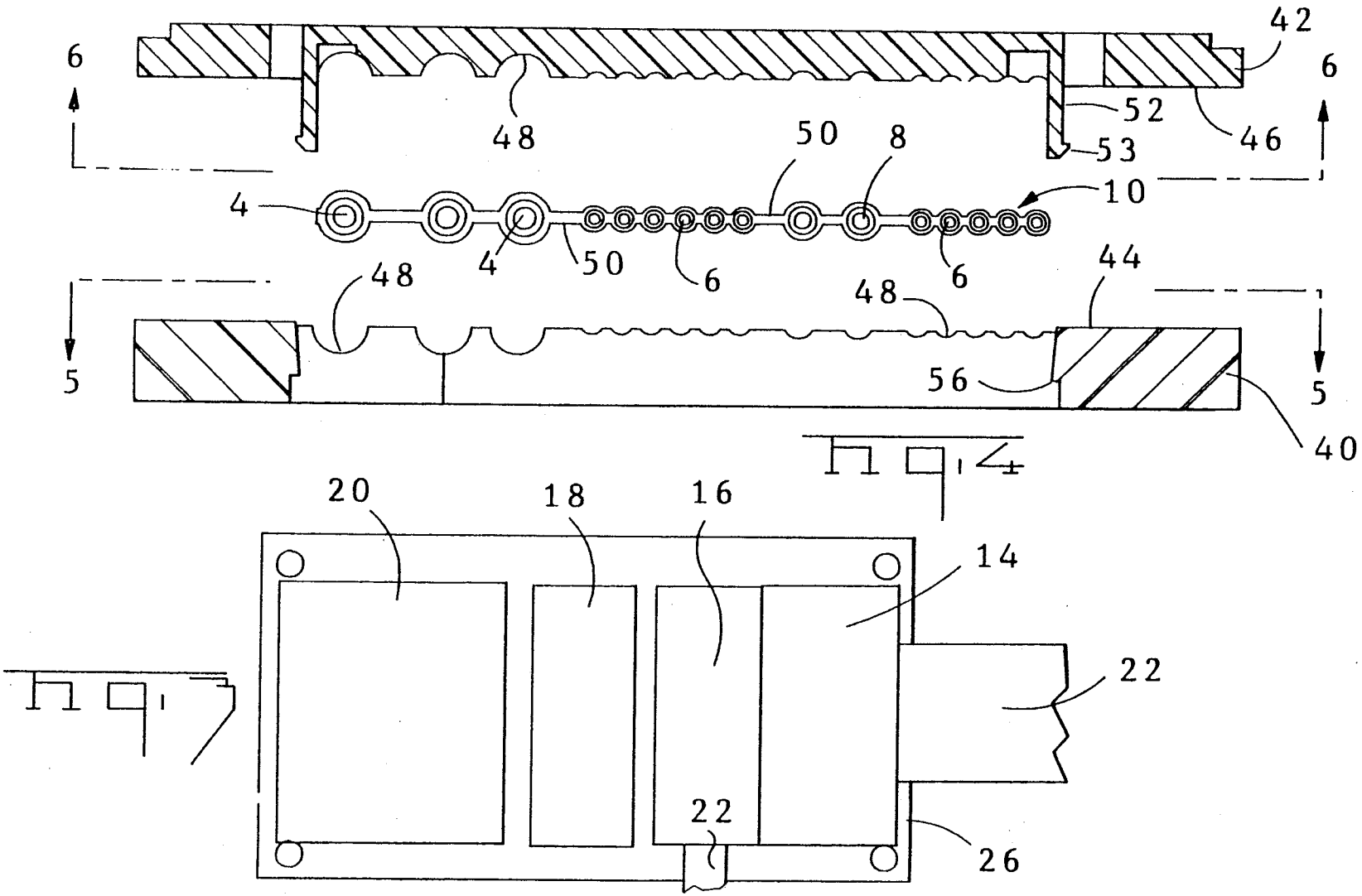
42
6
46
52
53
10
8
50
6
50
48
4
4
6
40
5
44
56
48
48
5
4
14
16
18
20
22
26
22

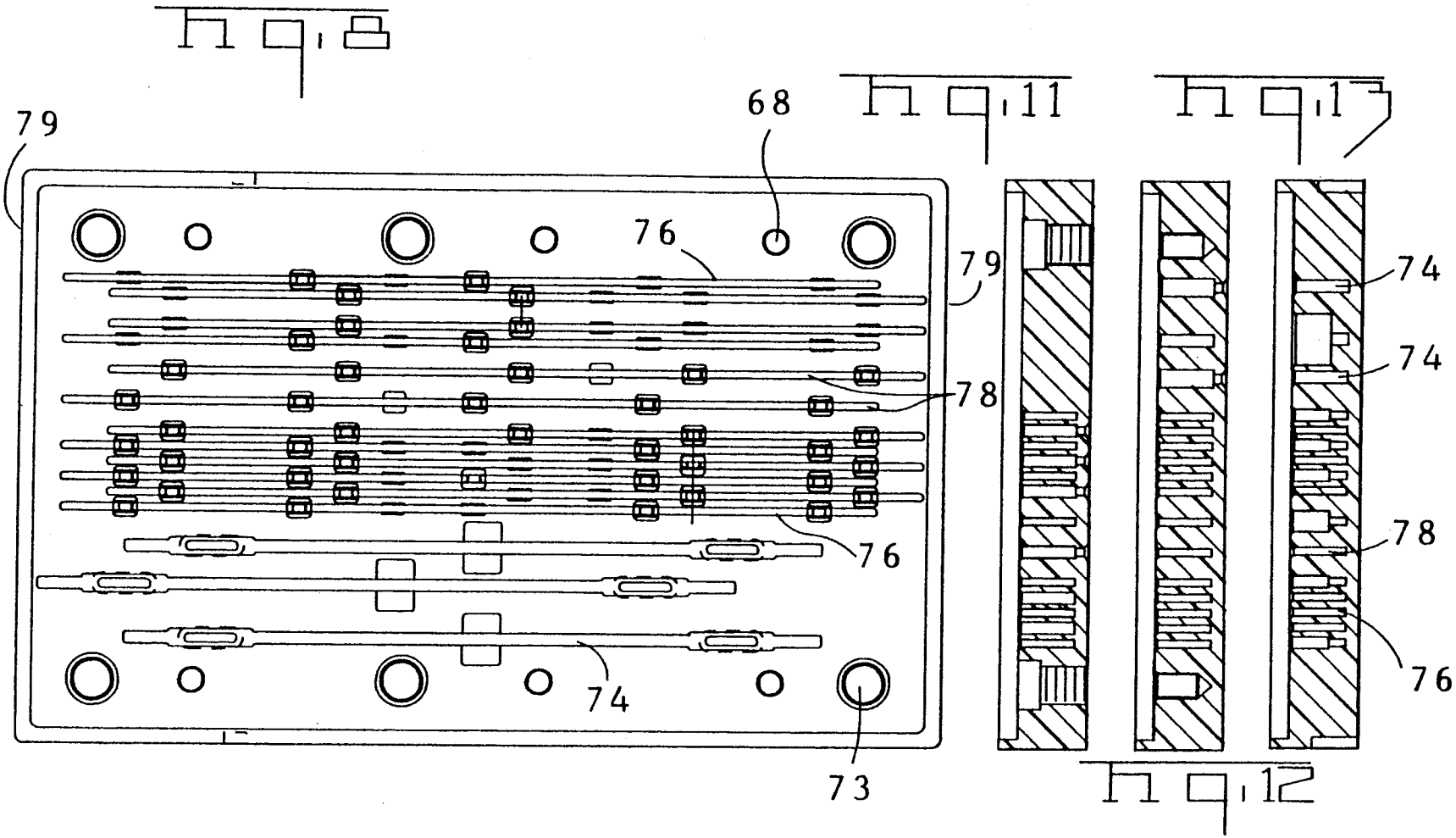
74
74
78
76
11
12
11
79
78
76
73
68
76
74
79

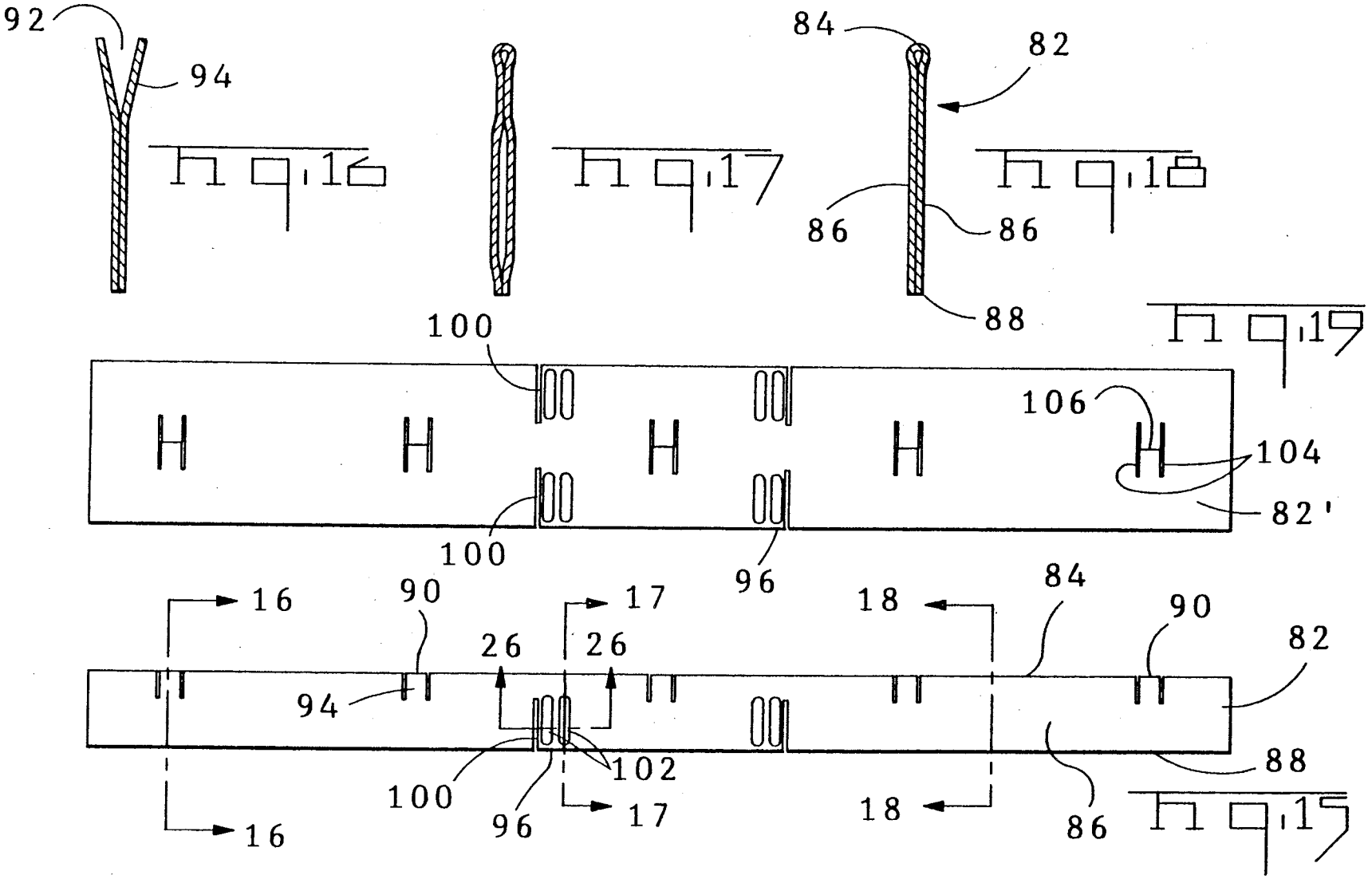
82
84
86
86
88
92
94
16
17
100
100
106
104
82'
96
18
18
17
26
26
102
17
96
100
90
94
16
16
84
90
82
88
86

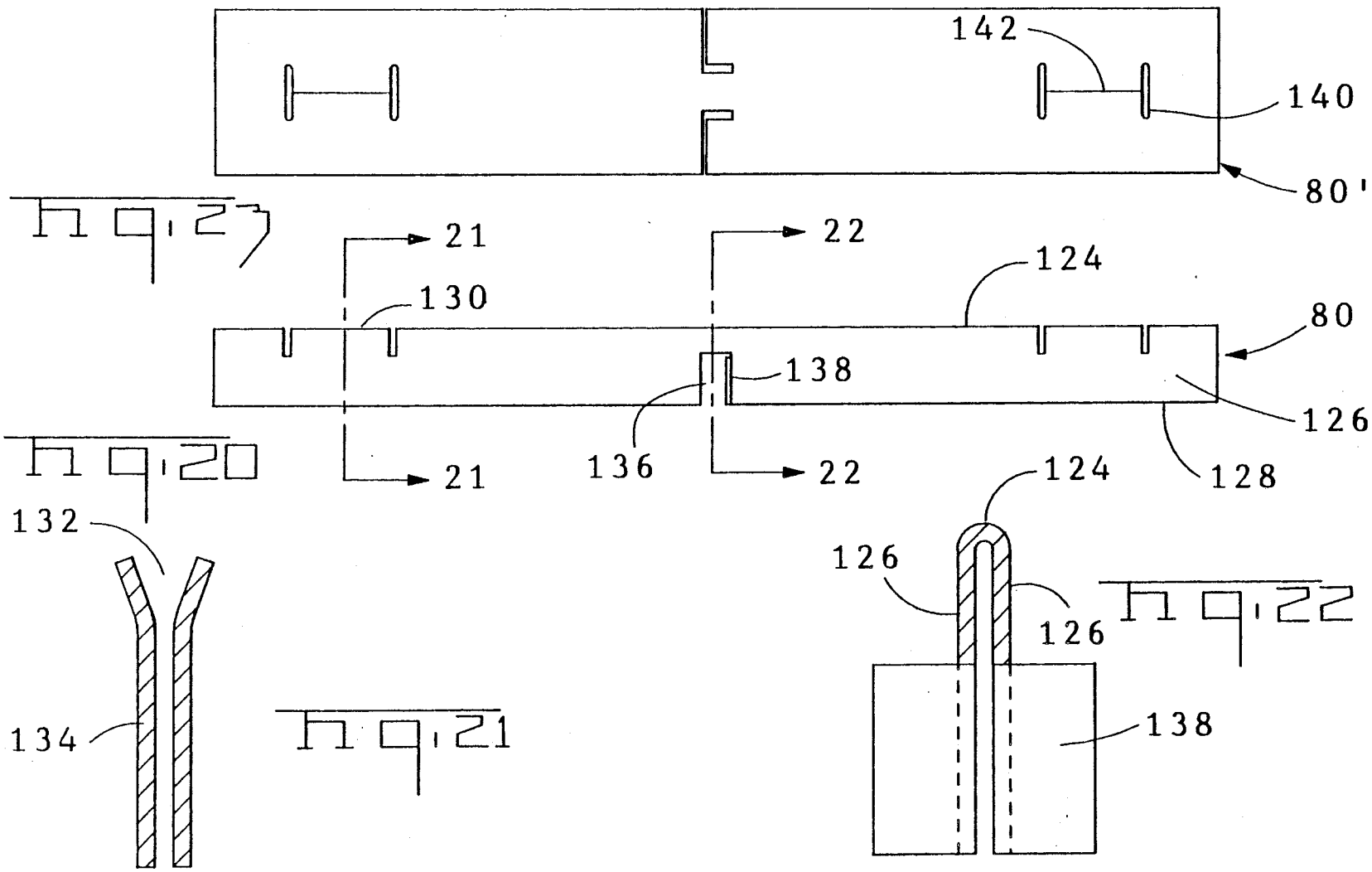
140
80'
142
80
126
128
124
22
138
136
21
130
124
126
138
126
22
21
132
134

ELECTRICAL TAP CONNECTOR

FIELD OF THE INVENTION

This invention relates to electrical connectors for making tap or branch connections to conductors in an electrical cable.

BACKGROUND OF THE INVENTION

U.S. Pat. No. 3,444,506 is representative devices for making electrical tap connections to the conductors in a flat conductor cable. The connecting system shown in that patent comprises an insulating support having a plurality of double-ended connecting devices mounted therein. One end of each connecting device extends beyond a cable supporting surface of the insulating support and has a wire-receiving slot therein for reception of a wire in the cable. The other end of each connecting device extends beyond the opposite surface of the insulating support so that a further connecting device can be coupled to the other end of each connecting device. In use, the cable is clamped against the one surface so that the individual wires in the cable are moved into the wire-receiving slots of the connecting devices and the further connecting device can then be coupled to the other ends of the connecting devices.

The connecting device shown in U.S. Pat. No. 3,444,506 lacks several advantages which are achieved in the practice of the present invention as will be described below. For example, the connecting device shown in the prior art patent requires that a separate connecting device be used for every connection which must be made between a conductor in the cable and the external conductor to which the cable conductor is to be connected. If two or three external conductors are required to be connected to a single cable conductor, three connecting devices must be connected to the cable conductor. It follows that a specialized connecting device must be manufactured for every specific circuit arrangement requiring electrical connections between the conductors in the cable and the external conductors, the specialized device being produced with connecting devices at the precise locations which are needed for the circuit patterns which are to be achieved.

The connecting device shown in U.S. Pat. No. 3,444,506 requires that all of the wires in the flat conductor cable be of the same gauge and there are many circumstances under which it would be desirable to make connections to a cable having wires of different gauges therein.

The present invention is directed to the achievement of a connector for making tap connections to the conductors in a flat conductor cable which has a high degree of versatility as regards, for example, the number of wires in the cable, the gauges or diameters of the wires, and the number and locations of the electrical connections between the cable wires and the external conductors. The invention is further directed to the achievement of a tap connector system which permits conventional electrical connectors having male tab contacts extending from their mating faces to be coupled to the tap connecting device and thereby connected to the conductors in the flat cable. The invention is also directed to the achievement of a tap connector by means of which two or more electrical connections can be made to an individual conductor in the cable and which can be mated with electrical connectors that have male tab contacts extending therefrom.

THE INVENTION

The invention comprises, in one embodiment, a cable tap connector for selectively connecting each one of a plurality of tap conductors to a predetermined cable wire in a cable in accordance with a specific wiring plan. The tap conductors include male terminals on their ends, the terminals being contained in a plurality of connector housings. Each male terminal is in a predetermined position in a predetermined one of the connector housings. The cable tap connector assembly comprises a housing assembly having a plurality of elongated bus conductors and a cable wire locating means therein for locating the cable wires in side-by-side parallel relationship with the bus conductors extending parallel to the cable wires and with each bus conductor being associated with a single cable wire when the cable wires are placed in the wire locating means. Each of the bus conductors has a cable wire connecting device thereon for forming an electrical connection with its associated cable wire. The housing assembly has a major surface and the bus conductors and the cable wires extend parallel to the major surface with the bus conductors proximate to the surface and the cable wires remote from the major surface. Each of the bus conductors has at least one receptacle site for reception of a male terminal. Each receptacle site is in a predetermined position between the ends of its respective bus conductor and the housing assembly has openings extending from the major surface to the receptacle sites. The major surface has a plurality of zones thereon, each zone containing a plurality of openings which extend to a group of receptacle sites on predetermined bus conductors. The openings in each zone are located in positions which correspond to the positions of a group of predetermined male terminals in a predetermined one of a connectors so that upon placement of the cable wires in the cable wire locating means, the tap conductors can be connected to the cable wires in accordance with the specific wiring plan by coupling the connectors with the receptacle sites in the zones on the major surface. In the preferred embodiment, each of the bus conductors and its associated cable wire are coplanar and define a plane which extends substantially normally of the major surface. The center to center spacing between adjacent bus conductors is the same as the center to center spacing between adjacent cable wires.

In one embodiment, the cable tap connector is characterized in that the assembly is intended for a cable which comprises some cable wires that have a relatively coarse gauge and other cable wires which have a relatively fine gauge. The coarse gauge wires are connected to relatively heavy or large male terminals and the finer gauge wires in the cable are connected to relatively smaller male terminals. The male tab terminals may in turn be connected to relatively coarse and fine gauge tap wires or may be connected to active devices in the connector housings.

In the preferred embodiment, the housing assembly comprises a bus housing subassembly and a cable wire locating and clamping subassembly. The subassemblies have opposed internal faces which are substantially against each other with the bus conductors in the bus conductor subassembly and the cable wire locating means in the cable wire locating subassembly. The bus conductors are contained in parallel slots which are proximate to the internal face of the bus conductor subassembly. The bus conductors in one embodiment are sheet metal bus bars having receptacle portions for the male contact members and having connecting devices thereon which extend to the cable conductors in the cable clamping and locating means. The connecting devices which extend from the bus conductors to the cable conductors are, in one embodiment, separate sheet metal double-ended connecting devices which are mated with the bus conductors and which have wire receiving slots for establishing electrical contact with the cable conductors. The connecting devices extend through internal passageways in the housing assembly which extend between the bus receiving slots and the cable locating means.

THE DRAWING FIGURES

FIG. 3 is a plan view showing the locations of connectors coupled to the cable tap assembly.

FIG. 4 is a sectional exploded view showing the two sections of the cable clamping and wire locating subassembly.

Figure 5:
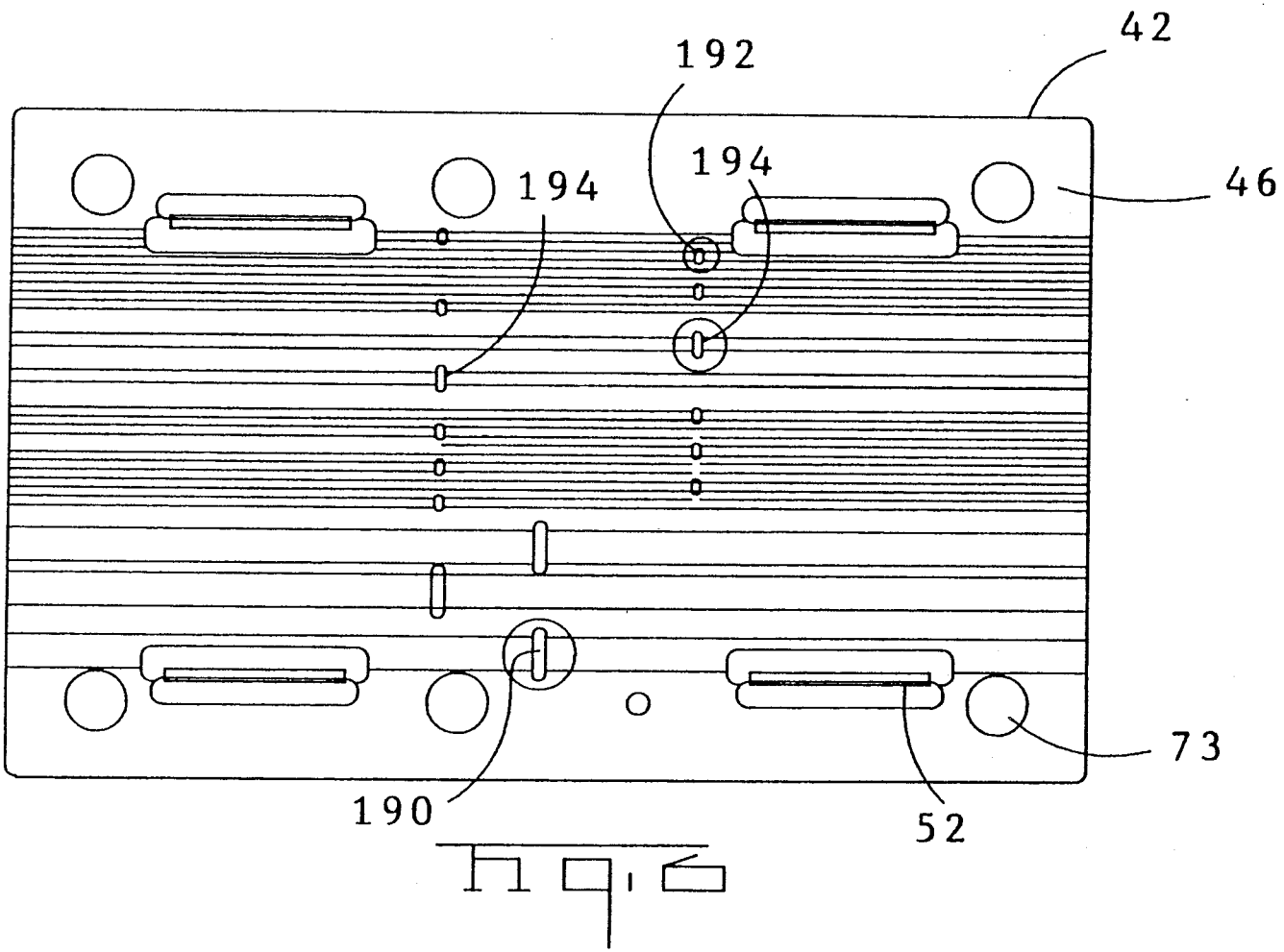
Figures 7, 10:
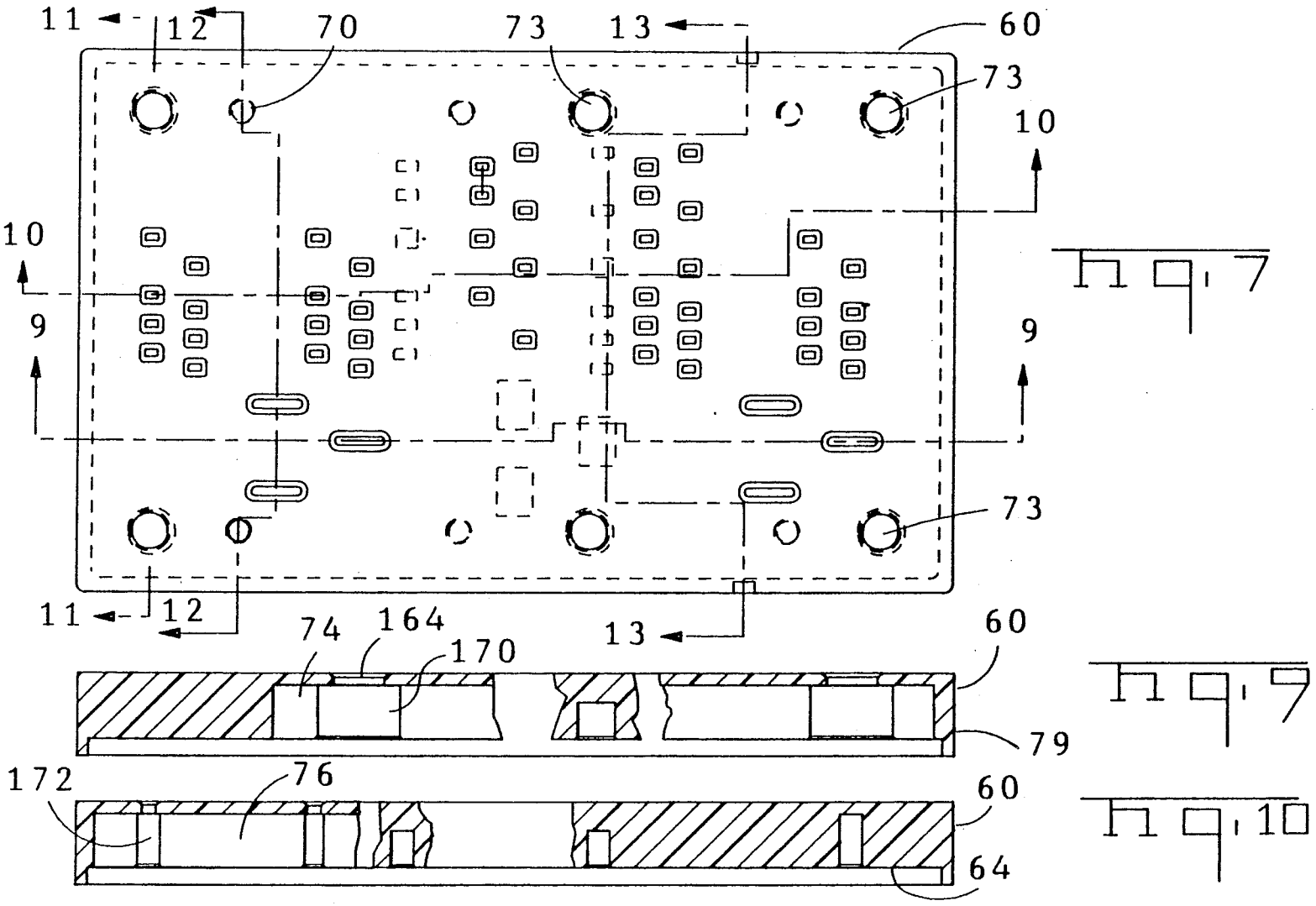

FIGS. 5 and 6 are views looking in the direction of the arrows 5—5 and 6—6 of FIG. 4.

Figure 7:
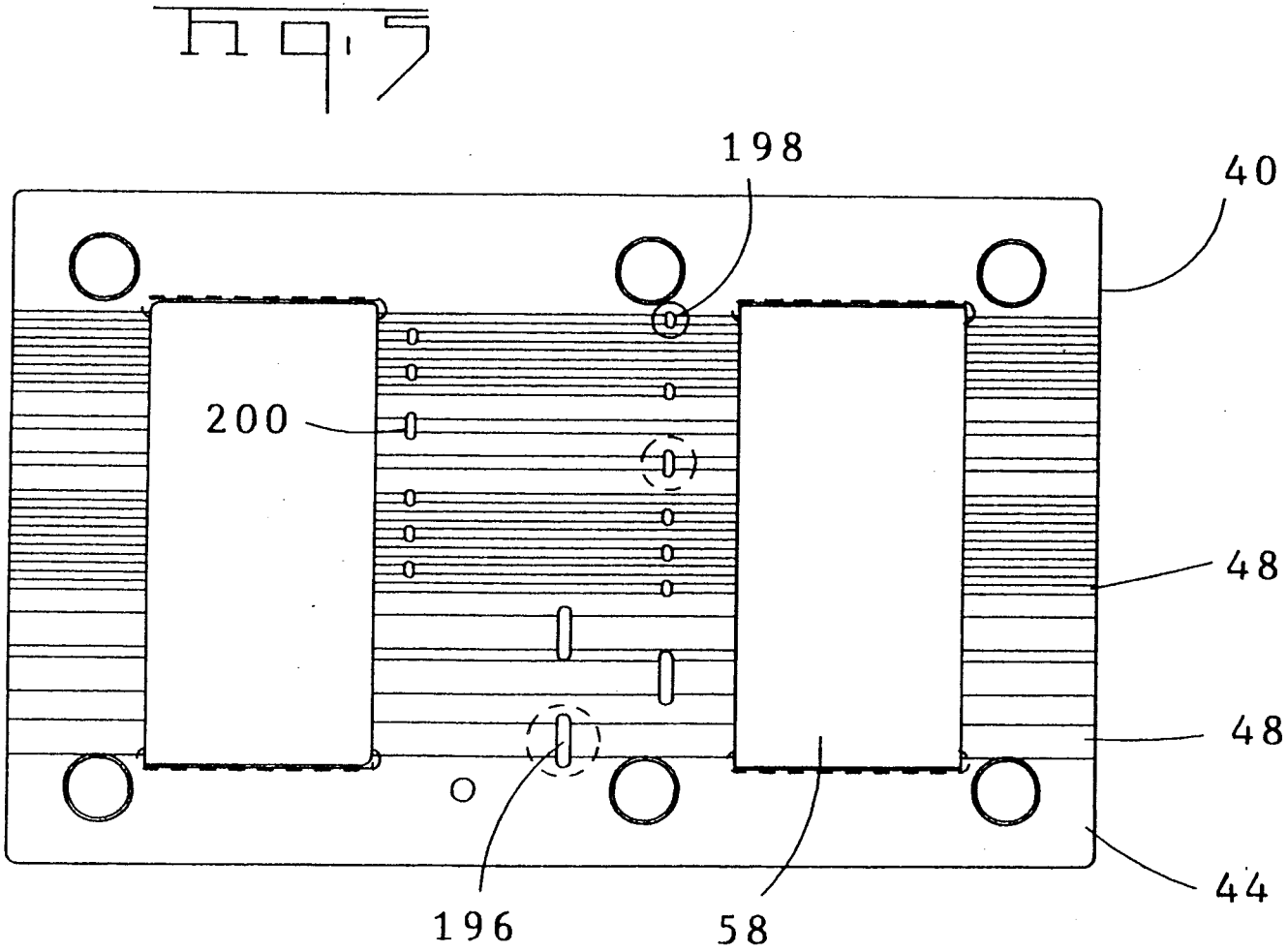

FIG. 7 is a top plan view of the bus conductor housing body.

FIG. 8 is a plan view of the underside of the bus conductor housing body.

FIGS. 9, 10, 11, 12, and 13 are sectional views looking in the directions of the correspondingly numbered arrows of FIG. 7.

Figure 14:
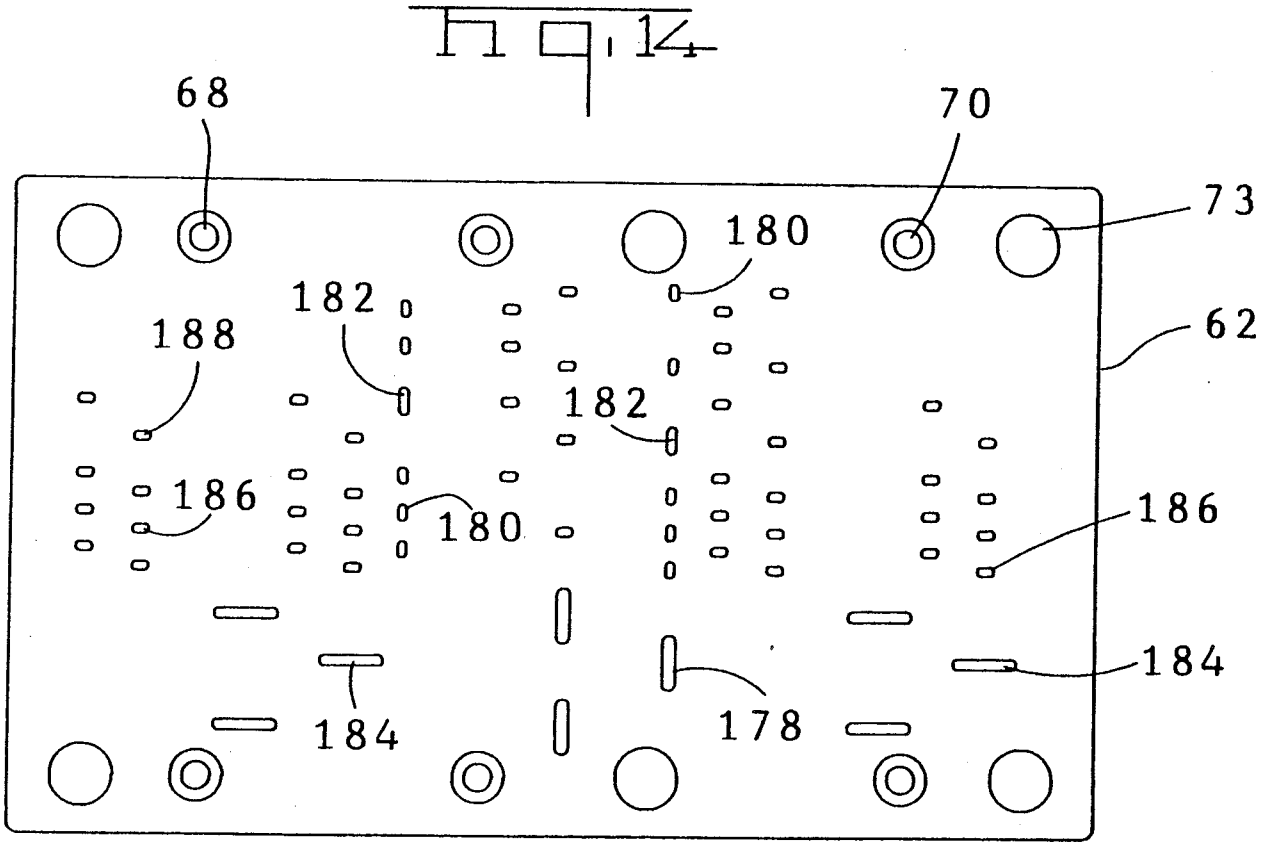

FIG. 14 is a plan view of the cover and retaining plate of the bus housing subassembly.

FIG. 15 is a side view of one of the bus bars which are contained in the bus housing.

FIGS. 16, 17, and 18 are views looking in the directions of the correspondingly numbered arrows in FIG. 15.

FIG. 19 is a plan view of the blank from which the bus bar of FIG. 15 is formed.

FIG. 20 is a side view of another type of bus bar which is contained in the bus housing.

FIGS. 21 and 22 are sectional views looking in the directions of the correspondingly numbered arrows in FIG. 20.

FIG. 23 is a plan view of the blank from which the bus bar of FIG. 20 is formed.

Figure 24:
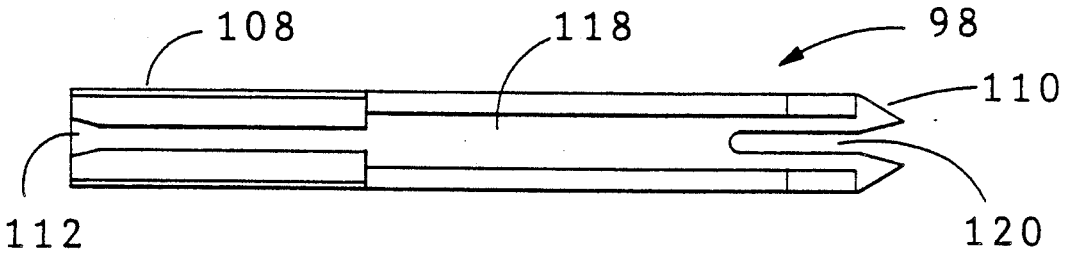

FIG. 24 is a frontal view of a connecting device used with the bus bar of FIG. 15.

Figure 25:
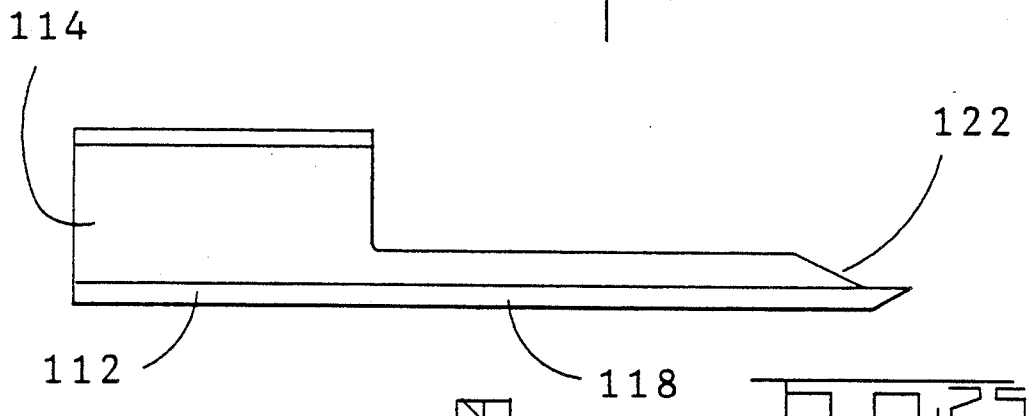

FIG. 25 is a sectional view looking in the direction of the arrows 25—25 of FIG. 24.

Figure 26:
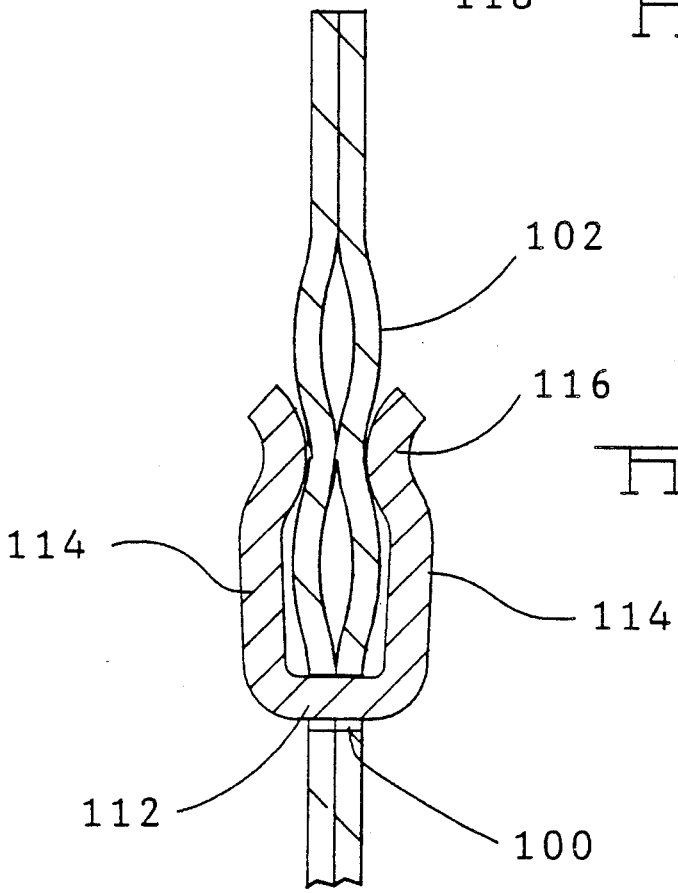

FIG. 26 is a view looking in the direction of the arrows 26—26 of FIG. 15 and showing the connecting device of FIG. 25 coupled to the bus bar.

Figure 27:
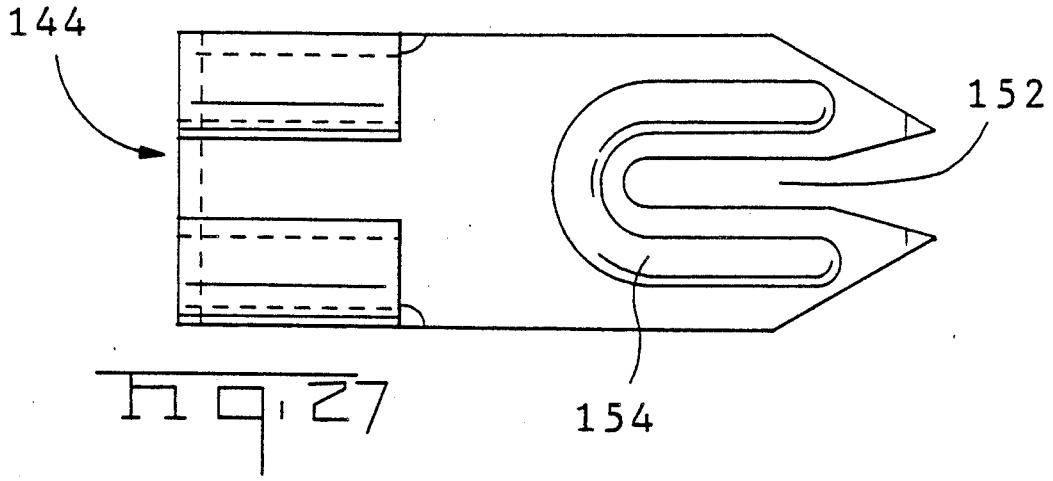

FIG. 27 is a frontal view of the type of connecting device used with the bus bar shown in FIG. 20.

Figure 28:
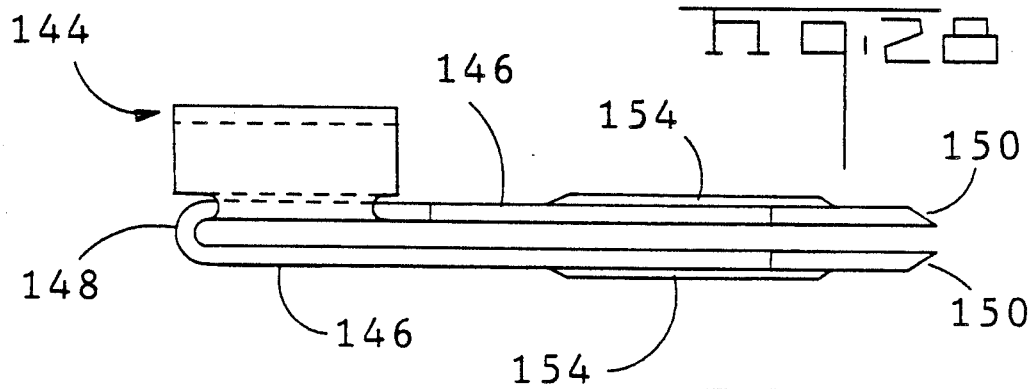
Figure 29:
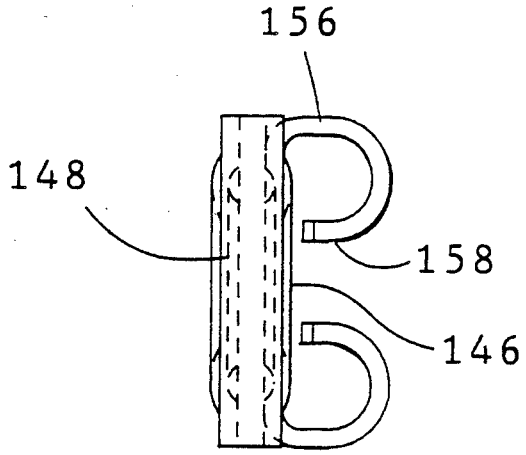

FIGS. 28 and 29 are side and top views of the connecting device shown in FIG. 27.

Figure 30:
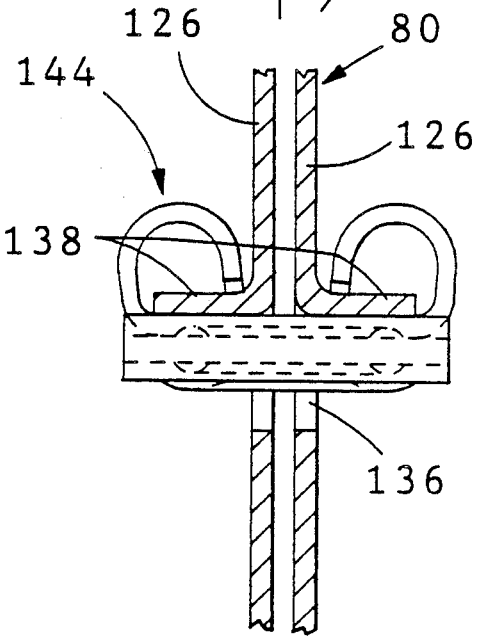
Figures 11, 12:
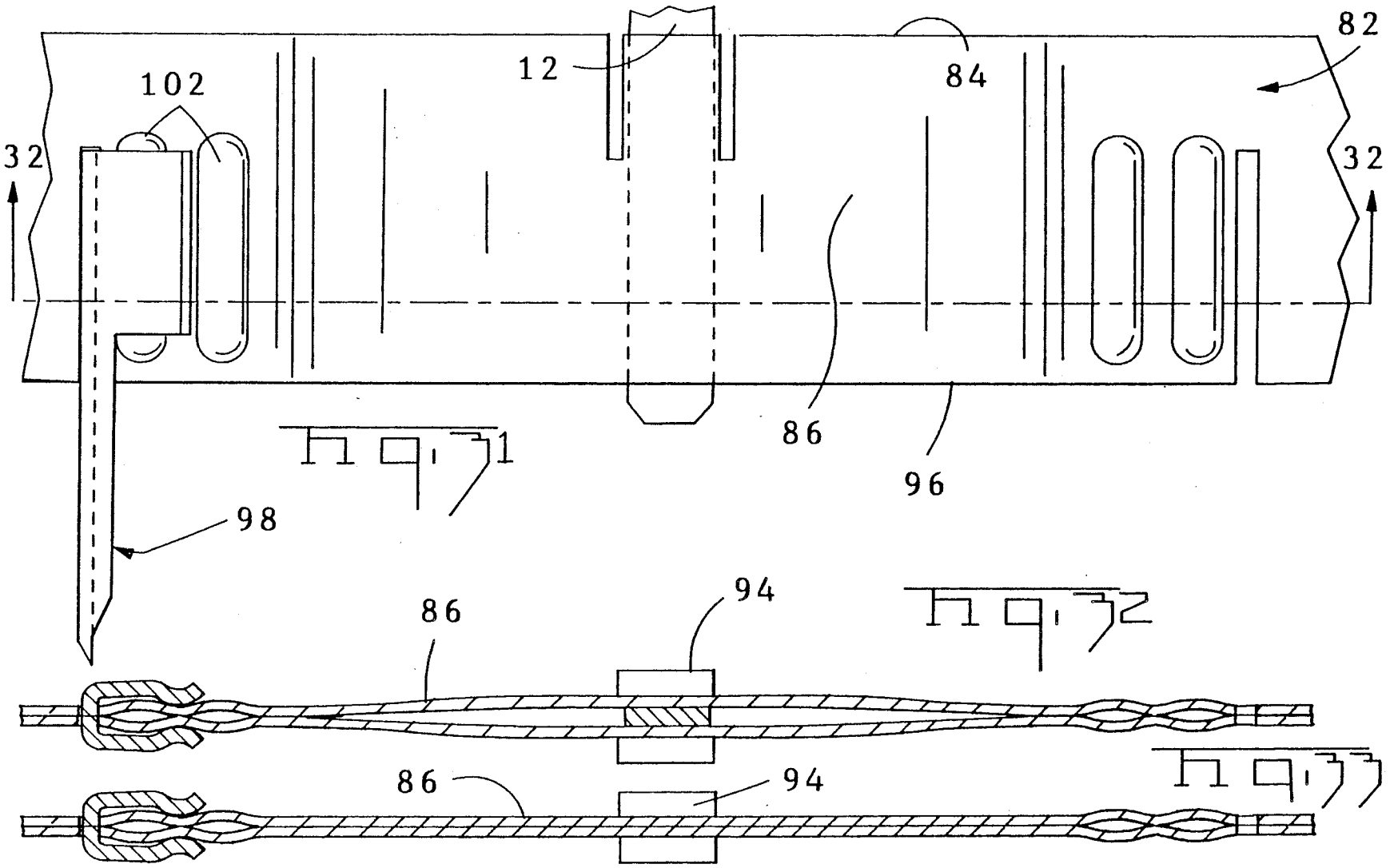
Figure 14:
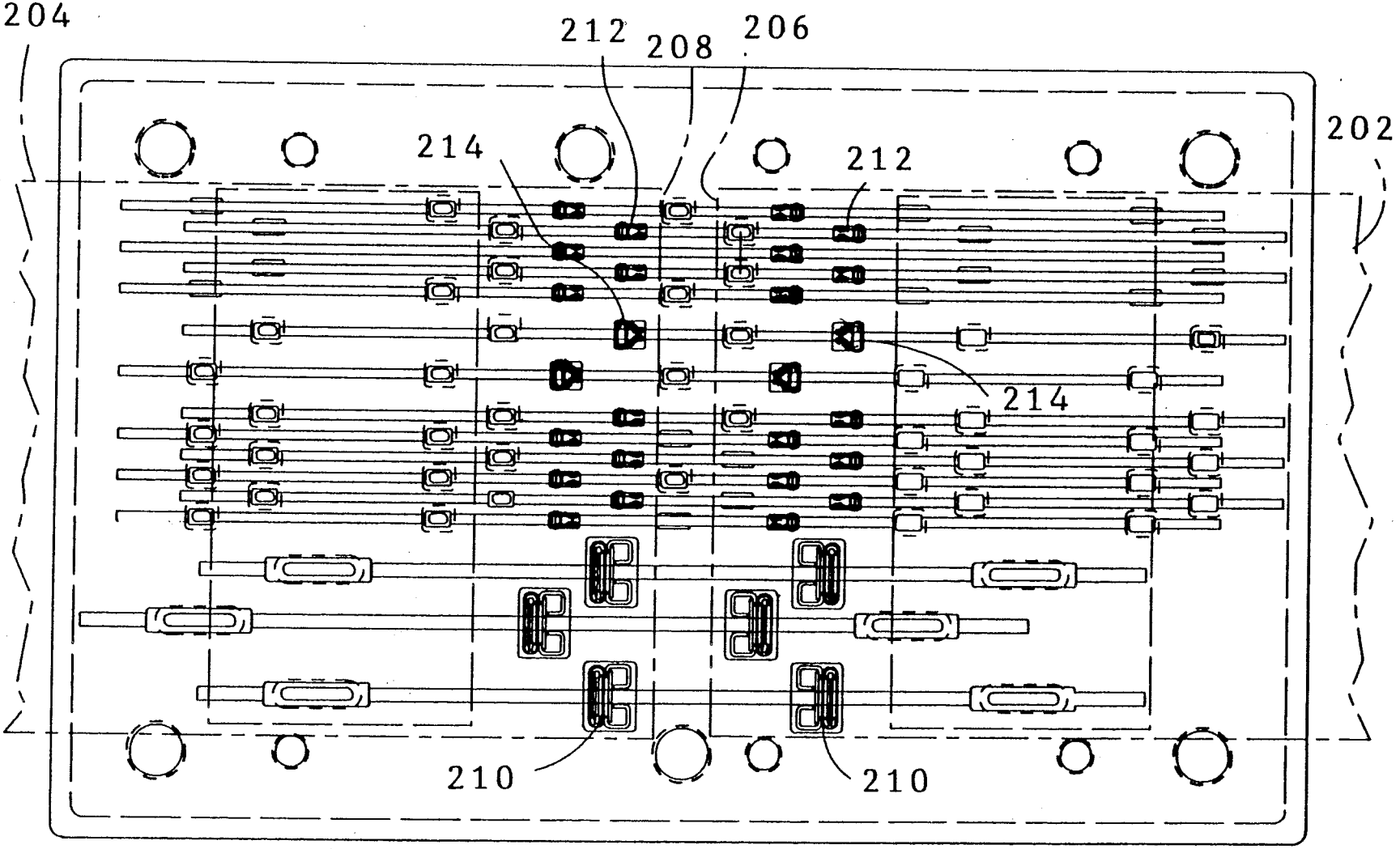

FIG. 30 is a sectional view showing the connecting device of FIG. 27 coupled to the bus bar of FIG. 20.

FIG. 31 is a fragmentary view of a portion of the bus bar of FIG. 15 showing a male tab terminal inserted into a receptacle site and showing a connecting device coupled to the bus bar.

FIG. 32 is a view looking in the direction of the arrows 32—32 of FIG. 31.

FIG. 33 is a view similar to FIG. 32 but showing the positions of the parts prior to insertion of the tab terminal.

FIG. 34 is a schematic view of an alternative embodiment which has the capability of splicing the ends of two cables.

THE DISCLOSED EMBODIMENT

Figure 1:
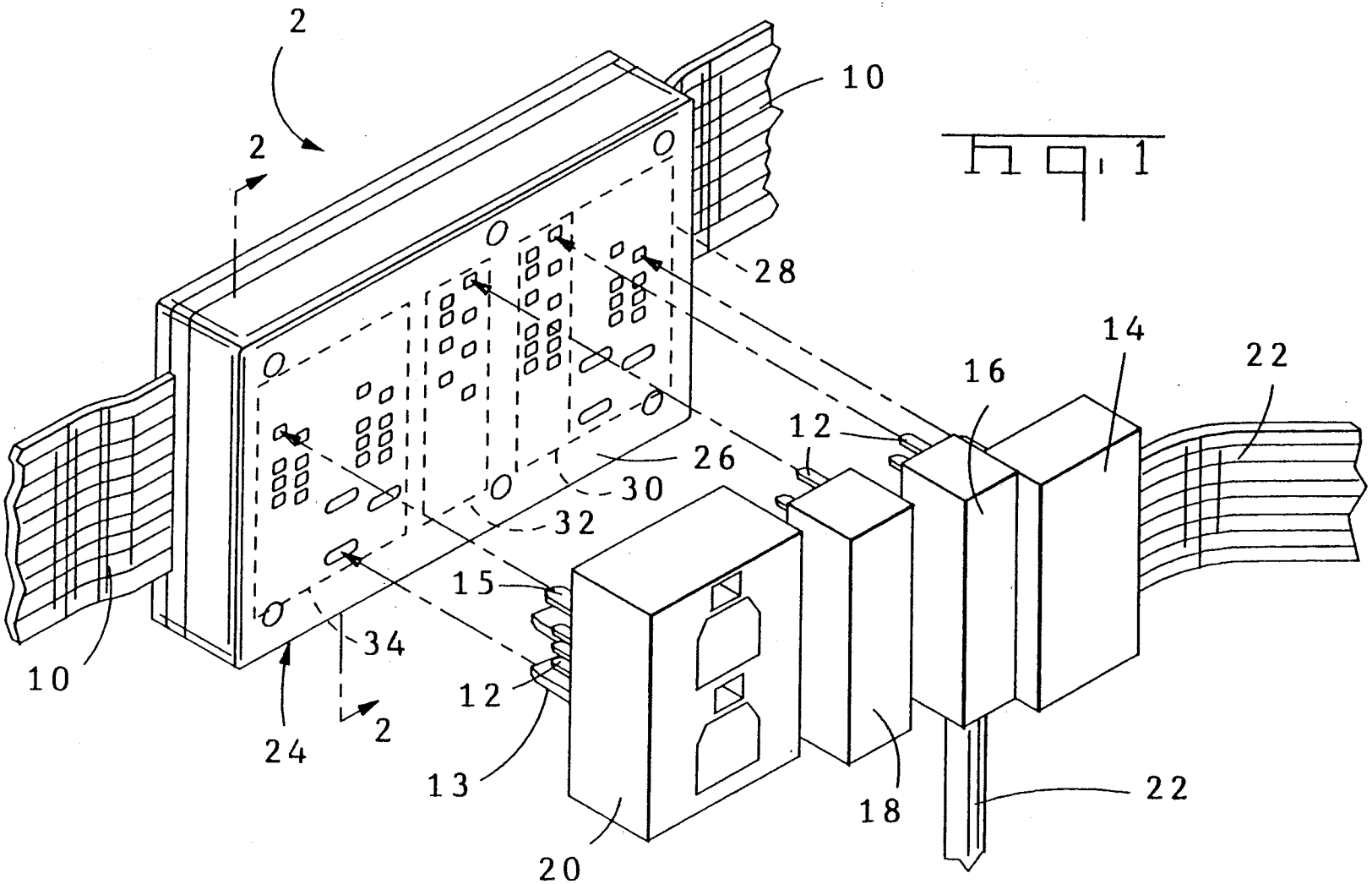
FIG. 1 is a perspective view of a cable tap assembly in accordance with the invention.
Figure 2:
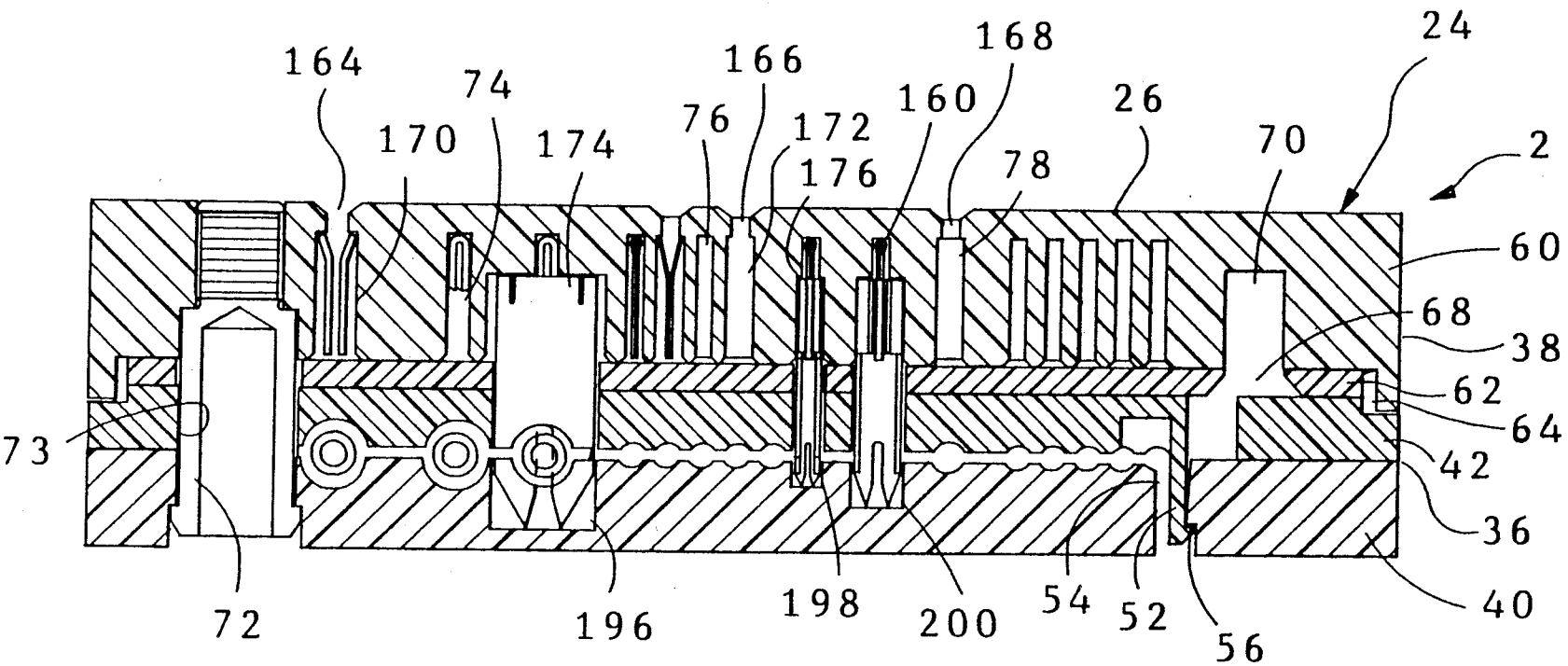
FIG. 2 is a sectional view taken along an irregular section line 2—2 in FIG. 1.

A cable tap connector assembly 2 in accordance with the invention, FIGS. 1–3, serves to connect male terminals 12, 13, 15 contained in connectors 14, 16, 18, 20 to wires 4, 6, 8 which are contained in a cable 10. The cable 10 (FIG. 4) has three relatively coarse wires 4, relatively fine gauge wires 6, and two wires 8 of intermediate gauge. A cable of this type might be used in the wiring for a building in which case the wires 4 would be power supply wires, the wires 6 could be control circuits and the intermediate gauge wires 8 might be part of an uninterrupted power system. The connectors 14, 16, 18, 20 can be conventional connectors having tap wires extending therefrom and having terminal tabs on the ends of the tap wires. Alternatively, they could contain active devices, for example, controlling devices for controlling appliances or apparatus to which the cable conductors extend. The term "connector" is used herein in a broad sense. One or more of the connectors might be a conventional connector having tap wires extending to tab terminals contained in the connector housing, one or more of the connectors may be a housing containing active devices but having no tap wires extending to the housing, and one or more of the connectors may be a hybrid containing an active device and having wires extending to terminals in the connector housing.

The connectors 14, 16, 18, and 20 have terminal tabs 12, 13, and 15 of varying sizes extending therefrom. The tabs 13 which are connected to the coarse gauge conductors are relatively large, the tabs 12 which are connected to the fine gauge conductors wires are relatively small, and the tabs 15 which are to be connected to the wires of intermediate gauge are of intermediate size.

The tap connector assembly 2 comprises a housing assembly 24 which has a major surface 26 which contains separate zones 28, 30, 32, and 34. Each zone receives one of the connectors 14–20 as shown in FIG. 3 and the male tab terminals extending from these connectors are connected to the individual cable wires 4, 6, 8 as will be described below.

The housing assembly 24 is made up of a cable clamping and wire locating subassembly 36 and a bus conductor housing subassembly 38. The cable clamping subassembly, FIG. 4–6, comprises two plate-like sections 40, 42 which have opposed surfaces 44, 46. These surfaces have semi-cylindrical depressions 48 located on the same centers as the conductors in the cable 10 and have diameters which match the diameters of the insulation on the wires in the cable. When the two sections are against each other, the conductors in the cable are firmly clamped in predetermined positions with the web portions 50 of the cable extending between adjacent conductors. The two sections 40, 42 are secured to each other by latch arms 52 which depend from the section 42 and which have latch ears 53 on their ends. The latch arms extend through openings in the lower section 40 and the ears lodge against latch shoulders 56 as shown in FIG. 2. Rectangular openings 58 are provided in the lower section 40 in order to permit inspection of the lower surface of the cable when the assembly has been installed on a cable. It can be determined by inspecting the cable through these openings if the cable is properly positioned in the depressions in the cable clamping sections.

The bus housing subassembly, FIGS. 2 and 7–14, comprises a main housing body 60 and a cover or retaining plate 62 which is fitted into a recess 64 on the underside of the housing body 60. This retaining plate or cover is secured to the main housing body by fasteners which extend through aligned openings 68, 70. The bus housing subassembly and the cable clamping subassembly are secured to each other by a plurality of plastic snap fasteners 72 which extend through aligned openings 73 in the two subassemblies.

The bus bars, which are described below, are contained in parallel slots 74, 76, 78 which extend inwardly from the downwardly facing surface of recess 64, as viewed in FIG. 2, of the housing body 60 and which extend parallel to the major surface. These slots extend between the ends 79 of the housing body 60 but are staggered as shown in FIG. 8 for reasons which will become apparent from the following description. The slots 74 receive bus bars 80 and the slots 76 receive bus bars 82.

When the cable tap connector 2 is placed in service, the coarse gauge wires 4 will carry a relatively high current and the finer gauge wires 6, 8 will carry correspondingly lower currents. The bus bars 80, 82, 160 and the male tab terminals 12, 13, 15 are accordingly dimensioned so that they are suitable for the currents and voltages encountered.

Each of the bus bars 82, FIG. 15, is associated with one of the relatively fine gauge cable wires 6 and comprises a stamped and formed sheet metal member having a bight 84 and coextensive side walls or arms 86 which are against each other or substantially so as shown in FIG. 18. A plurality of receptacle sites 90 are provided in the bight for tab terminals, each site comprising an opening 92 in the bight and divergent ears 94 which function as a guide or lead-in for the tab when it is inserted into the space between the side walls 86.

At least one cable wire connecting site 96 is provided for a connecting device 98 on the outer ends 88 of the side walls 86. Each connecting site 96 comprises aligned slots 100 which extend inwardly from the outer ends 88 and a pair of spaced-apart embossments 102 which extend parallel to the slots 100. The manner in which the connecting devices are coupled to the bus bar 82 is described below and shown in FIG. 26.

The bus bar 82 is produced from a flat blank 82', FIG. 19, by stamping parallel slots 104 in the blank between the side edges thereof and sharing the blank along share lines 106 which extend between the slots. The blank is then bent into the form shown in FIG. 18 so that the material on each side of the shear lines 106 form the divergent ears 94. The forming process should be carried out in a manner which will produce severe work hardening in the bight 84 in order that the side walls 86 may function as stiff springs as will be briefly described below.

The connecting device 98 (FIGS. 24–26) is of stamped and formed sheet metal and has an end, 108, which is coupled to the bus bar and an end 110 which is connected to the wire. The end 108 has a web section 112 from which side walls 114 extend. These side walls are inwardly formed at their outer ends as shown at 116. The device is coupled to the bus bar by moving the web into the aligned slots 100 so that the inwardly formed portions 116 of the side walls lodge in the depressions between the spaced-apart embossments 102.

The side walls are of reduced height in the intermediate portion 118 of the connecting device and are tapered adjacent to the end 110 as shown at 122. A wire receiving slot 120 extends inwardly from the end 110 and the web is pointed on each side of this slot to facilitate penetration of the insulation of the cable when the bus housing subassembly 38 is assembled to the cable clamping subassembly 36.

The bus bar 80, FIGS. 20–23 is of a heavier gauge sheet metal than the bus bar 82 for the reason that it is intended for use with the coarse gauge conductors in the cable and will therefore carry a higher current. This bus bar has a bight 124 from which the side walls or arms 126 extend tangentially. The receptacle sites 130 are formed as described above, that is by punching spaced-apart slots 140 in the flat blank 80' and sharing the material between the slots as shown at 142. When the blank is bent into the shape of FIGS. 21 and 22, the ears 134 will be flexed outwardly and the opening 132 for the male tab will be produced.

The cable wire connecting sites comprise relatively wide aligned slots or openings 136 which extend inwardly from the ends 128 of the side walls 126. Flanges 138 extend outwardly from the sides of the slots for cooperation with the terminals or connecting devices (FIGS. 27–29) which are coupled to the bus bar.

The connecting device 144 (FIGS. 27–30) comprises parallel plate-like members 146 which are joined to each other by a reversely bent portion 148 at their upper ends as viewed in FIG. 28. The ends of the plate-like members are pointed as shown at 150 and each plate-like member has a wire-receiving slot 152. Advantageously, the plate members are embossed as shown at 154 adjacent to the wire-receiving slots for added stiffness. The upper portions of each connecting device are connected to the bus bar by means of ears which extend from the plate-like member on the left shown in FIG. 28. Each ear 156 is reversely curled as shown at 158 so that its end is spaced from the surface of the associated plate member 146. The connecting device 144 can be coupled to its associated bus bar by moving the reversely bent section 148 into the aligned slots in an orientation such that the flanges are received between the ends of the ears 158 and the adjacent surface of the plate member 146 in the manner of a conventional quick disconnect electrical terminal.

A bus bar of intermediate size 160, FIG. 2, is provided for the conductors 8 in the cable 10 which are of an intermediate gauge and an appropriately sized connecting device is provided for the bus bar 160. The bus bar 160 can be of either type described above and need not therefore be described in detail.

FIGS. 31–33 illustrate the manner in which the bus bar 82 is deflected when a male tab terminal 12 is inserted into one of the receptacle sites. The side walls or arms 86 are flexed outwardly and bowed as shown in FIG. 32 by virtue of the fact that they are constrained by the bight portions 84 on each side of the receptacle sites. Extremely good area contact is achieved as shown in FIG. 32 and a high contact force can be achieved if desired. The force is produced in a large part by the bowing of the side walls but there is to some extent a contribution to the total force by the cantilever flexure of the side walls away from each other. The contributing factors to the total contact force are complex and will depend upon several variables such as the thickness of the material, the hardness, and the degree of work hardening in the bight 84. Advantageously, the parts are designed such that the flexure illustrated in 32 is entirely, or at least substantially, within the elastic range so that when the tab terminal 12 is removed, the parts return to their original positions as shown in FIG. 33.

The receptacle sites in the bus bars are accessible from the major surface 26 through openings 164, 166, 168 which extend to the slots 74, 76, 78 that receive the bus conductors. The slots are slightly enlarged in the vicinity of the receptacle sites as shown at 170, 172 (FIG. 2) in order to permit the side walls of the bus bars to move apart when the male terminals are inserted. Otherwise, the bus bars are closely confined in their respective slots in order that they will be precisely positioned with respect to their associated cable wires.

Cavities of substantial width are provided in the lower surface of the housing body 60 as shown at 174, 176 for the portions of the connecting devices 98, 144 which are mated with the bus bars.

The connecting devices extend from the bus bars to the cable wires and must therefore extend through the clamping section 42 and the retaining plate 62. Suitable openings are therefore provided in the plate as shown at 178, 180, and 182. The upper section 42 of the cable clamping subassembly 36 is also provided with openings 190, 192, 194 at locations where the connecting devices must extend to the individual cable wires. The openings in the plate member 42 and the aligned openings in the cover member 62 thus define internal passageways which extend from the individual contacting sites on the ends of the bus bars to the cable locating means in the cable locating subassembly 36. As shown in FIG. 2, it is necessary to provide recesses 196, 198, and 200 for the end portions of the connecting devices since these end portions extend past the plane occupied by the cable wires.

It is desirable to provide openings as shown at 187, 186, and 188 in the cover plate 62 in order that there will be clearance for the end portions of the male tab terminals if the dimensions of the parts are such that these tab terminals extend past the ends of the side walls of the bus bars. In FIG. 31, the end portion of the tab terminal 12 does in fact extend beyond the ends 96 of the side walls 86 so that an opening in the cover plate would be required.

The cable tap connector 2 is assembled and installed on the cable 10 in the following manner. The cable 10 is first positioned as shown in FIG. 4 between the two sections 40, 42 of the cable clamping subassembly and the two sections are assembled to each other by means of the latch arms 52 so that the cable will be firmly clamped in the subassembly. The individual bus bars 80, 82 and their connecting devices 98, 144 are assembled to the main housing body 60. The cover 62 is then assembled to the housing body 60 and secured in place by fasteners as described above. The two subassemblies 36, 38 are then pressed together so that the connecting devices move through the passageways and penetrate the insulation of the cable 10. The individual cable wires 4, 6, 8 are received in the wire-receiving slots of the connecting devices thereby establishing conducting paths extending from the cable wires to the bus bars as required. Finally, the snap fasteners 72 are assembled to two subassemblies to secure the parts in their assembled relationship. The individual connectors 14–18 can then be mated with the cable connector in the zones on the major surface described above thereby to connect the male tabs extending from the connectors to the cable wires.

FIG. 34 shows in schematic form an alternative embodiment which is capable of forming splice connections between the ends of cables 202, 204 in addition to connections between male tab members and the wires in the cables. In this embodiment, each bus bar has two connecting devices 210, 212, 214 located adjacent to the center of the bus bar so that one of the connecting devices will engage a conductor in the end 206 of the cable 202 and the other connecting device will engage the corresponding conductor in the end 208 of the cable 204 so that the aligned corresponding conductors in the cables will be connected to each other. This feature of splicing the ends of cables can be used independently of the cable tapping capabilities of the system. It should be added, also, that under some circumstances, it may be desirable to provide two connecting devices on each bus bar for making two connections to the cable wires purely for purposes of redundancy.

The bus bars can be of a single thickness of sheet metal rather than being folded as described above. As an alternative, the bus bars can be in the form of a rod or heavy gauge wire. If the rod is a wire, the receptacle sites can be receptacle connecting devices and crimped onto the bus conductors. The connecting devices can similarly be crimped onto a wire-type bus.

The bus bars can, if desired, extend normally of the cable wires rather than parallel to the wires, if desired. The parallel arrangement shown is preferable for the reason, among others, that connections between the individual bus conductors and the wires can be placed at any location along the length of the bus conductor.

The invention can be used under a wide variety of circumstances in which several different types of circuits are required and particularly where different wire gauges are required. For example, in the wiring of a building, the power can be supplied by the coarse gauge wires, communications and control circuits can be connected to the fine gauge wires, and the intermediate gauge wires can be used for emergency circuits (e.g., emergency lighting) which are required in the event of a power failure.

It will be seen from the foregoing description that the invention provides a relatively simple, and therefore reliable, system for making multiple tap connections to single wires in a flat conductor cable. Furthermore, the system is extremely versatile in that the connector receiving zones 28–34 on the major surface 26 can extend across any or all of the bus bars so that the terminal tabs in a single connector can be selectively connected to any of the cable wires. FIGS. 1 and 3 show only one possible arrangement for the connectors and it should be pointed out that any number of individual zones can be provided on the major surface for any number of connectors desired.

We claim:

1. A cable tap assembly for selectively connecting each one of a plurality of tap conductors to a predetermined cable wire in a cable in accordance with a specific wring plan, the tap conductors including male terminals on their ends, the terminals extending from at least one connector housing, each male terminal being in a predetermined position in the connector housing, the cable tap assembly comprising:

a cable tap assembly having a bus housing assembly and a cable wire locating subassembly, said bus housing subassembly including a plurality of elongated bus conductors, and said cable wire locating subassembly including a plurality of cable wire locating means for locating the cable wires in side by side parallel relationship where said subassemblies have opposed internal faces which are substantially against each other, said bus conductors extending parallel to the cable wires with each bus conductor being associated with a single cable wire when the cable wires are placed in the wire locating means, each of the bus conductors having a cable wire connecting device for forming an electrical connection with its associated cable wire, the housing assembly having a major surface, the bus conductors and the cable wires extending parallel to the major surface with the bus conductors proximate to the major surface and the cable wires remote from the major surface, each of the bus conductors having at least one receptacle site for reception of a male terminal, each receptacle site being in a predetermined position between the ends of its respective bus conductor, the housing assembly having openings extending from the major surface to the receptacle sites, the major surface comprising at least one zone which contains a plurality of openings which extend to a group of receptacle sites on predetermined bus conductors, the openings in the zone being located in positions which correspond to the positions of a group of predetermined male terminals in the connector, whereby upon placement of the cable wires in the cable wire locating means, the tap conductors can be connected to the cable wires in accordance with the wiring plan by coupling the connector with the receptacle sites in the zone on the major surface.

2. A cable tap assembly as set forth in claim 1 characterized in that each of the bus conductors and its associated cable wire are coplanar and define a plane which extends substantially normally of the major surface.

3. A cable tap assembly as set forth in claim 1 characterized in that the center to center spacing between adjacent bus conductors is the same as the center to center spacing between adjacent cable wires.

4. A cable tap assembly as set forth in claim 1 characterized in that the assembly is intended for a cable which comprises some cable wires having a relatively course gauge and other cable wires having a relatively fine gauge, the bus bars which are associated with the coarse gauge cable wires having a relatively high current carrying capacity, the bus bars which are associated with the relatively fine gauge cable wires having a relatively lower current carrying capacity.

5. A cable tap assembly as set forth in claim 1 characterized in that the bus conductor subassembly has parallel slots which are proximate to the internal face thereof, the bus conductors being in the slots.

6. A cable tap assembly as set forth in claim 5 characterized in that the bus conductors are sheet metal bus bars.

7. A cable tap assembly as set forth in claim 1 characterized in that the cable wire locating subassembly comprises two plate-like members which are against each other and which have opposed surfaces, the cable wire locating means being on the opposed surfaces.

8. A cable tap assembly as set forth in claim 7 characterized in that each of the cable wire connecting devices comprises a sheet metal connecting device which is on its respective bus bar, the assembly having internal passageways extending from the bus conductors to the cable wire locating means, the connecting devices extending through the passageways and having ends which are proximate to the cable wire locating means, the ends having wire-receiving slots for the cable wires for forming the electrical connections with the cable wires.

9. A cable tap assembly for selectively connecting each one of a plurality of tap conductors to a cable wire in a cable in accordance with a specific wiring plan, some of the cable wires being of a relatively coarse gauge and other cable wires being of a relatively fine gauge, the wiring plan requiring that specific cable wires be connected to specific tap conductors, the tap conductors having male terminals on their ends, the terminals being contained in a plurality of connectors, each male terminal being in a predetermined position in a predetermined one of the connectors, the cable tap assembly comprising:

a housing assembly having a plurality of elongated bus bars and a cable wire locating means therein for locating the cable wires in side by side parallel relationship, the bus bars extending parallel to the cable wires with each bus bar being associated with a single cable wire when the cable wires are placed in the wire locating means, each of the bus bars having a sheet metal connecting device thereon for forming an electrical connection with its associated cable wire, each of the connecting devices having a remote end which is proximate to the cable wire locating means, the remote ends of the connecting devices having wire-receiving slots for reception of the cable wires, the bus bars which are associated with the coarse gauge cable wires having a relatively high current carrying capacity, the bus bars which are associated with the relatively fine gauge cable wires having a relatively lower current carrying capacity, the housing assembly has a major surface, the bus bars and the cable wires extending parallel to the major surface with the bus bars proximate to the major surface and the cable wires remote from the major surface, each of the bus bars having receptacle sites for reception of male terminals, each receptacle site being in a predetermined position between the ends of its respective bus bar, the housing assembly having openings extending from the major surface to the receptacle sites, the major surface comprising a plurality of connector receiving zones, each zone containing a plurality of openings which extend to a group of receptacle sites on predetermined bus bars, the openings in each zone being located in positions which correspond to the positions of a group of predetermined male terminals in a predetermined one of the connectors whereby, upon placement of the cable wires in the cable wire locating means, the tap conductors can be connected to the cable wires in accordance with the wiring plan by coupling the connectors with the receptacle sites in the zones of the major surface.

10. A cable tap assembly as set forth in claim 9 characterized in that the zones extend transversely of the bus bars so that the zones contain openings which extend to receptacle sites on a plurality of bus bars.

11. A cable tap assembly as set forth in claim 9 characterized in that the cable assembly is intended for use with a cable having at least two coarse wires which are power supply wires and a plurality of relatively fine wires which are signal wires, at least one of the zones containing openings which extend to receptacle sites on bus bars which are associated with the power supply wires and contains openings which extend to receptacle sites on bus bars associated with signal wires.

12. A cable tap assembly as set forth in claim 9, characterized in that each of the connecting devices is a double-ended stamped and formed connecting device having one end which is coupled to its respective bus bar, the other end being its remote end.

13. A cable tap assembly as set forth in claim 12 characterized in that each cable wire and its associated bus bar are coplanar and define a plane which extends normally of the major surface.

14. A cable tap assembly as set forth in claim 13 characterized in that the housing assembly has internal passageways extending from the bus bars to the cable locating means, the connecting devices extending through the passageways.

15. A cable tap assembly as set forth in claim 9 characterized in that the housing assembly comprises a bus housing subassembly and a cable wire locating subassembly, the subassemblies having opposed internal faces which are substantially against each other, the bus bars being in the bus conductor subassembly and the cable wire locating means being in the cable wire locating subassembly.

16. A cable tap assembly as set forth in claim 15 characterized in that the cable wire locating subassembly comprises two plate-like members which are against each other and which have opposed surfaces, the cable wire locating means being on the opposed surfaces.

17. A cable tap assembly as set forth in claim 16 characterized in that the bus conductors subassembly has parallel slots which are proximate to the internal face thereof, the bus bars being in the slots.

18. A cable tap assembly for selectively connecting each one of a plurality of cable wires in a cable to at least one tap conductor, the cable tap assembly comprising:

a housing assembly having cable wire locating means, a plurality of bus conductors, and cable wire contacting devices therein, the housing assembly comprising a bus conductor subassembly which contains the bus conductors and a wire locating subassembly which contains the cable wire locating means, the two subassemblies having opposed internal faces which are against each other when the subassemblies are assembled to each other, the wire locating subassembly comprising a pair of clamping plates which have opposed clamping surfaces, the clamping surfaces having depressions therein for locating the cable wires in side-by-side parallel relationship, the bus conductor subassembly having a plurality of parallel slots therein, the bus conductors being in the slots with each bus conductor in alignment with an associated cable wire, each of the bus conductors having at least one tap conductor contacting site, the tap conductor contacting sites being accessible from the exterior of the bus subassembly whereby tap conductor terminals on the ends of the tap conductors can be coupled to the bus conductors at the bus conductor contacting sites, each of the bus conductors having at least one cable wire contacting site, the cable wire contacting devices extending from the bus conductors at the cable wire contacting sites, the cable wire contacting devices extending from the bus conductors beyond the internal face of the bus conductor subassembly, the cable wire contacting devices having remote ends which are spaced from the bus conductors, the remote ends having wire receiving slots therein and, passageways are provided in the wire locating subassembly extending from the internal face thereof to, and past, the wire locating depressions, the passageways being dimensioned to receive the cable wire contacting devices whereby, upon placement of the cable wires between the clamping plates of the wire locating subassembly and upon assembly of the wire locating subassembly to the bus bar subassembly, the wire receiving slots in the cable wire contacting devices will receive the cable wires and the cable wires will be electrically connected to the bus conductors.

19. A cable tap assembly as set forth in claim 18 characterized in that each of the bus conductors has two cable wire contacting devices extending therefrom, the two contacting devices being spaced apart whereby the assembly can be used to make splice connections between corresponding cable wires in the ends of two cables upon placement of the ends in the wire locating subassembly.

20. A cable tap assembly as set forth in claim 18 characterized in that each of the cable wire contacting devices are double ended contacting devices having one end which is coupled to a bus bar, the other end being the remote end.

21. A cable tap assembly as set forth in claim 20 characterized in that the bus bars are sheet metal bus bars.

22. A cable tap assembly as set forth in claim 21 characterized in that the bus conductor subassembly has a major surface which is directed oppositely with respect to the internal face of the bus conductor subassembly, and openings extend into the major surface to the tap conductor sites, the openings providing the access to the tap conductor contacting sites for the tap conductor terminals.

23. A cable tap assembly as set forth in claim 22 characterized in that the bus conductor subassembly comprises a bus bar housing section and a retaining plate, the major surface being one major surface of the bus bar housing section, the bus bar housing section having an internal surface which faces oppositely with respect to the major surface, the retaining plate being against the internal surface, the slots and the bus bars being in the bus bar housing section.

24. A cable tap assembly for selectively connecting each one of a plurality of tap conductors to predetermined cable wires in a cable, comprising:

a cable tap assembly having a bus housing subassembly and a cable wire locating subassembly, said bus housing subassembly including a plurality of elongated bus conductors, and said cable wire locating subassembly including a plurality of cable wire locating means for locating the cable wires in side by side parallel relationship, where said subassemblies have opposed internal faces which are substantially against each other, a cable connecting device for forming an electrical connection between each bus connector and its associated cable wire;

at least one receptacle site on each bus conductor for establishing electrical contact with a tap conductor; and openings in the cable wire locating subassembly aligned with the receptacle sites;

whereby the bus conductors extend parallel to the cable wires with each bus conductor being associated with a single cable wire positioned by the cable wire locating means.

25. A cable tap assembly for selectively connecting a plurality of tap conductors to parallel wires in a flat cable, the tap conductors being positioned in one or more rows, the tap conductors being attachable to the cable tap assembly with the rows extending transversely to the direction of the wires in the cable, the cable tap assembly comprising:

a cable tap assembly having a bus housing subassembly and a cable wire locating subassembly, said bus housing subassembly including a plurality of elongated bus conductors, and said cable wire locating subassembly including a plurality of cable wire locating means for locating the cable wires in side by said parallel relationship, wherein said subassemblies have opposed internal faces which are substantially against each other, a cable connecting device for forming an electrical connection between each bus conductor and its associated cable wire;

whereby said bus conductors comprise straight members having a plurality of receptacle sites spaced apart along the length thereof and the cable wire locating subassembly has a plurality of openings, each opening being aligned with an associated receptacle site on the bus conductors, said receptacle sites and said openings forming groups of rows corresponding to the rows of tap conductors.

* * * * *